US006629723B1

(12) United States Patent
Trubee

(10) Patent No.: US 6,629,723 B1
(45) Date of Patent: Oct. 7, 2003

(54) TIP-PROOF PICNIC TABLE WITH ATTACHED BENCHES

(76) Inventor: Terry C. Trubee, 460 E. 15th St., Cookeville, TN (US) 38501

( * ) Notice: Subject to any disclaimer, the term of this patent is extended or adjusted under 35 U.S.C. 154(b) by 0 days.

(21) Appl. No.: 10/195,440

(22) Filed: Jul. 16, 2002

(51) Int. Cl.[7] ..... A47B 39/00
(52) U.S. Cl. ..... 297/158.3
(58) Field of Search ..... 297/158.3, 158.4, 297/158.5; 108/186, 187

(56) References Cited

U.S. PATENT DOCUMENTS

| | | | | |
|---|---|---|---|---|
| 2,568,633 A | | 9/1951 | Hagan | |
| 2,722,971 A | | 11/1955 | Gallagher | |
| 2,746,525 A | | 5/1956 | Cooper | |
| D178,535 S | | 8/1956 | Oglesby | |
| 2,805,708 A | | 9/1957 | Bohn | |
| 2,917,108 A | | 12/1959 | Moitz | |
| 3,262,734 A | | 7/1966 | Kuks | |
| 3,414,301 A | | 12/1968 | Crowe | |
| D232,673 S | | 9/1974 | Taylor | |
| 4,249,773 A | | 2/1981 | Giambalvo | |
| 4,330,151 A | * | 5/1982 | Healey | 297/158.3 |
| D266,376 S | | 10/1982 | Musgrove | |
| 4,607,880 A | * | 8/1986 | Gastebled | 297/158.5 |
| 5,803,536 A | * | 9/1998 | Perzee et al. | 297/158.5 |
| 6,186,590 B1 | * | 2/2001 | Tseng | 297/158.4 |

FOREIGN PATENT DOCUMENTS

| | | | | |
|---|---|---|---|---|
| CH | 344190 | * | 3/1960 | 297/158.3 |

* cited by examiner

*Primary Examiner*—Peter R. Brown
(74) *Attorney, Agent, or Firm*—Richard C. Litman

(57) ABSTRACT

The present invention is a picnic table with a table top and two bench seats detachably connected to two welded, tubular metal support units. Compoundly curved bench supports that rise from the ends of the otherwise straight footing member of each support unit transfer the force of weight applied to a bench seat to the ground, or floor directly beneath the bench and make the table tip-proof. The support units and metal braces rigidly support table top and benches against sway both longitudinally and transversely.

14 Claims, 4 Drawing Sheets

TIP-PROOF PICNIC TABLE WITH ATTACHED BENCHES

BACKGROUND OF THE INVENTION

1. Field of the Invention

The present invention relates to picnic tables and more specifically to picnic tables with attached benches.

2. Description of the Related Art

Picnic tables with attached benches found in public parks frequently are built using an A-frame support structure that requires users to step over the bench seat to sit at the table. These tables are unsuitable for use by many individuals unable or unwilling to climb into them, a problem eliminated by the ground-level footing member of the present invention. Tables with benches on A-frame support structures, and some tables with J-shaped supports, that mutually support bench seats and table tops have a tendency to tip when the benches are unevenly loaded. The present invention solves this problem by using compoundly curved bench supports to transfer the force of weight applied to a bench downward to the surface directly beneath the bench. Collapsible picnic tables with attached benches are manufactured for occasional use and for summer use in areas with cold climates; however, in warmer climes and where storage space is at a premium, tables are likely to remain in place year-round. The present invention answers the need for a year-round table that can meet a variety of decorative, size, and weight requirements.

U.S. Des. Pat. No. 178,535, issued to Ira D. Oglesby, U.S. Des. Pat. No. 232,673, issued to Charles P. Taylor, and, U.S. Des. Pat. No. 266,376, issued to Hryan H. Musgrove, show picnic tables with benches. However none of these patents show tubular bench supports with compound curves as in the preferred embodiment.

U.S. Pat. No. 2,568,622, issued to Robert E. Hagan, describes a lightweight, collapsible table with benches on pipe and tubing supports detachably secured, unlike the welded unit support system used in the preferred embodiment.

U.S. Pat. No. 2,722,971, issued to Hugh M. Gallagher and John V. Strasinger, describes four J-shaped metal tubular legs detachably secured with nuts and bolts, unlike the unitary construction of the present invention. Also, the supports Gallagher et al. describe project behind each bench, presenting a potential hazard to pedestrian traffic.

U.S. Pat. No. 2,746,525, issued to Calvin A. Cooper, describes a dismountable picnic table with detachable legs, benches, and table top, unlike the welded unit support system used in the preferred embodiment.

U.S. Pat. No. 2,805,708, issued to Glen W. Bohn, describes a picnic table with unit construction support structures. However, Bohn describes support structures for benches and table top made from two J-shaped tubular pieces connected by a crosspiece, a configuration that is more prone to bends and twists than the preferred embodiment which uses a single metal tubular footing member that supports benches on each of its compoundly curved ends and serves as a ground-level base for table support members. U.S. Pat. No. 2,917,108, issued to Donald B. Moitz, describes a table with four separate bent pipe table and bench supports, two detachably attached to each other at opposite ends of the table. Detachable tubular units as described by Moitz have more potential for undesired twisting than the welded support units used in the preferred embodiment. Additionally, the bench supports described by Moitz project beyond the benches and present a potential hazard to pedestrians.

U.S. Pat. No. 3,262,734, issued to Martin M. Kuks, describes a table with end units with raised crossbars between benches and table, requiring users to step over a crossbar or a bench to sit facing the table.

U.S. Pat. No. 3,414,301, issued to Robert W. Crowe, describes a table with tubular frame members joined by a connector tube having spring sleeves at its ends, unlike the welded construction of the present invention. Crowe also describes a single metal tube riser supporting each end of the table top. U.S. Pat. No. 4,249,773, issued to Joseph Giambalvo, describes a table built of aluminum tubing to be collapsible and portable but less durable than the preferred embodiment.

None of the above inventions and patents, taken either singularly or in combination, is seen to describe the instant invention as claimed. Thus a picnic table with attached benches solving the aforementioned problems is desired.

SUMMARY OF THE INVENTION

The present invention is a picnic table with a table top and two bench seats detachably connected to two support units constructed from tubular metal with welded joints. The present invention also includes strap metal braces, a table top cross, member, and connecting devices.

The unique design of the footing member of the support unit adds to the strength and stability of the table. Compoundly curved bench supports rise at the ends of the otherwise straight footing member to transfer the force of weight applied to a bench seat to the ground or floor directly beneath the bench.

Accordingly, it is a principal object of the invention to provide a picnic table that resists tipping, flexing, and twisting, and is strong and durable.

It is a another object of the invention to provide a picnic table with support units of welded unit construction that may be secured to a table top and bench seats with a minimum of skill and instructions, making it possible to inexpensively produce and to ship in a knocked down condition for assembly by the purchaser.

It is further object of the invention to provide a table with support units that are neat and attractive in appearance to be attached to table tops and benches made from a wide variety of readily available high strength, sun and water resistant materials including woods, such as redwood, pressure treated pine, and plywood, and other materials including plastic, metal, and all-weather composition board as appropriate for decks, pools a surrounds, patios, gardens, courtyards, and other outdoor areas at: residences, businesses, and public facilities.

It is a still further object of the invention to provide a table with entry to its bench seats unobstructed by structural support members.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
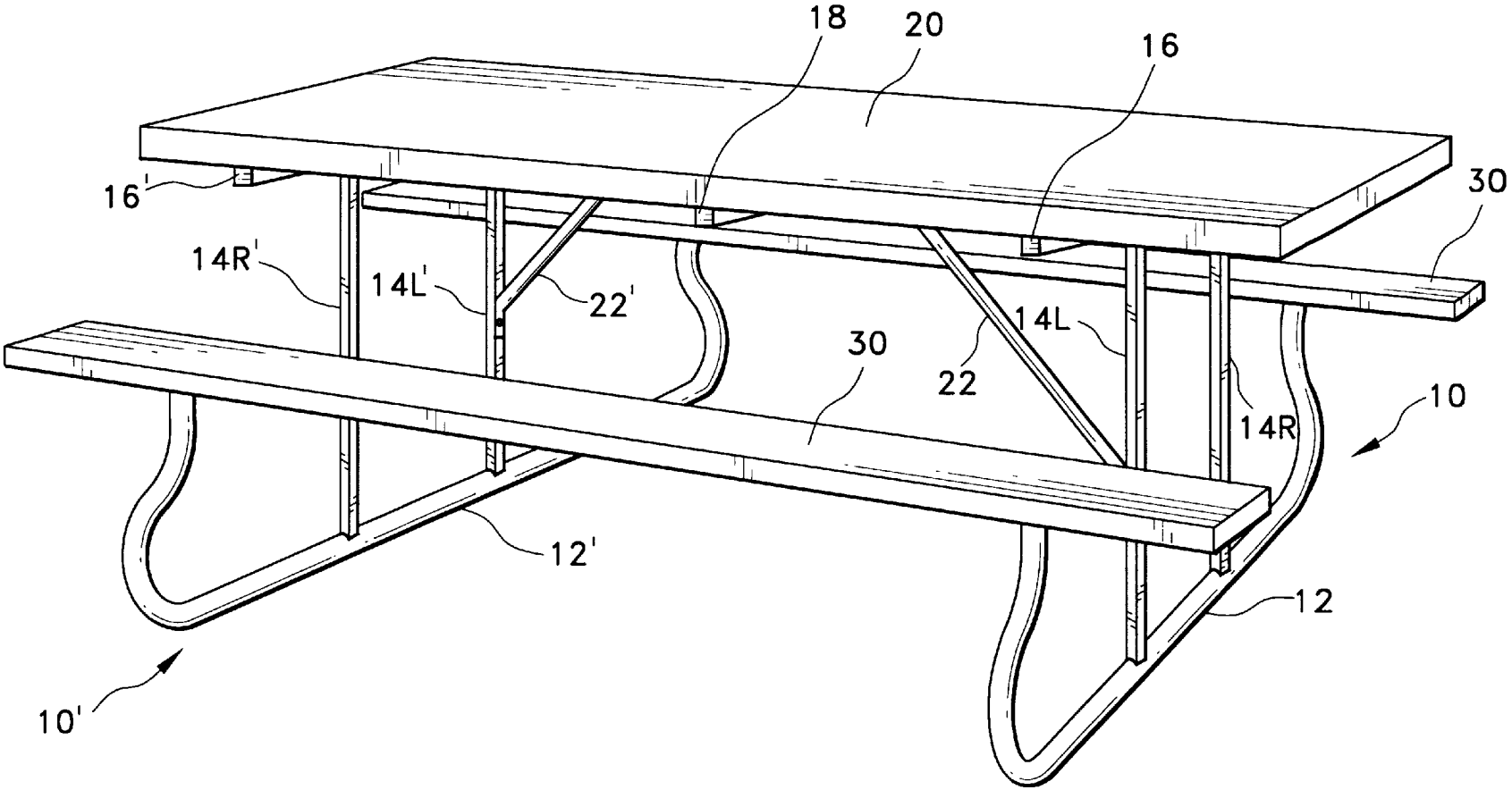
FIG. 1 is a perspective view of a picnic table with attached benches according to the present invention.

The present invention is a picnic table with attached benches made up of two substantially identical support units 10 and 10', a table top 20, and two bench seats 30 as shown in FIG. 1.

Figure 2:
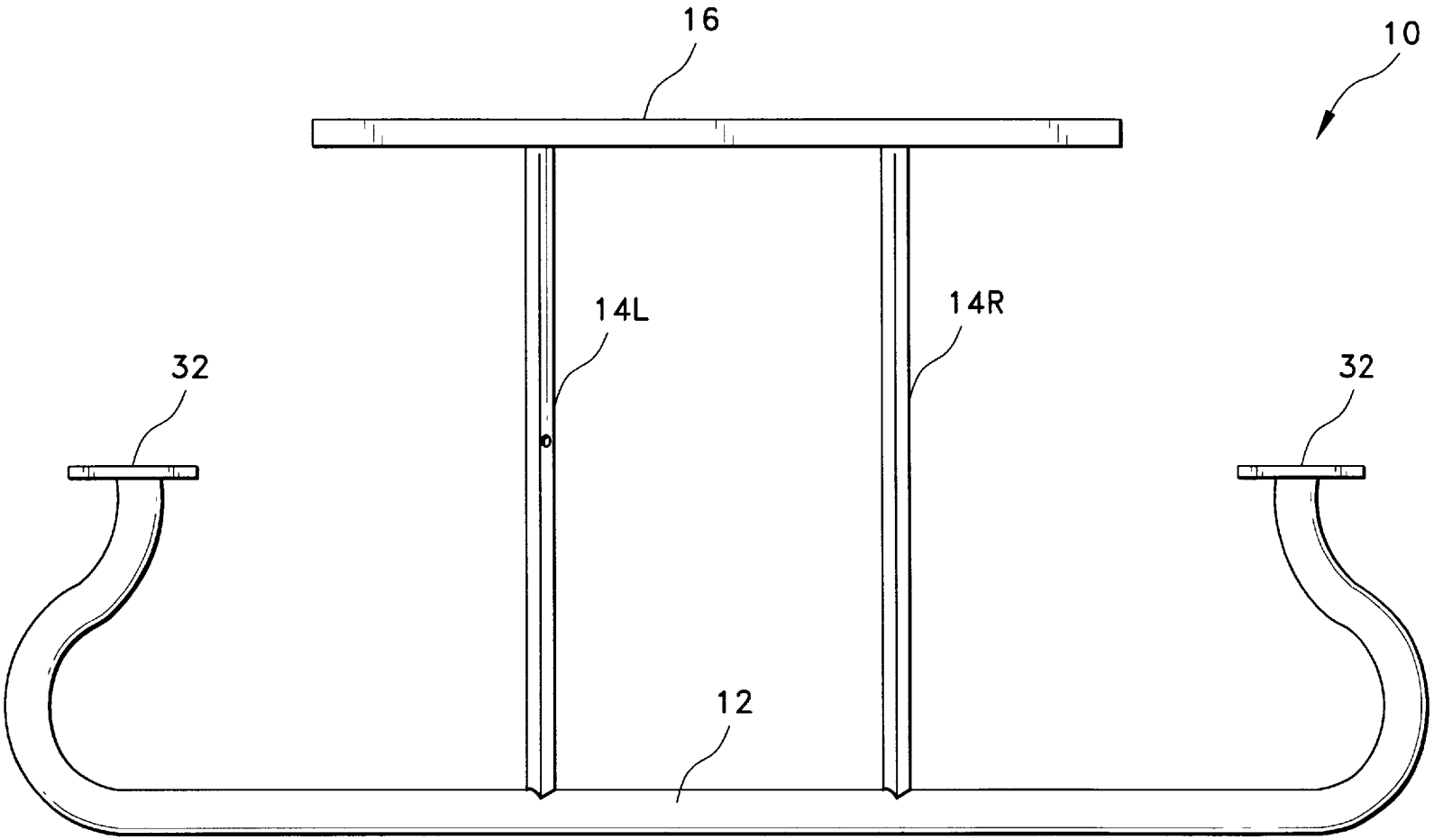
FIG. 2 is an elevational view of a picnic table support unit.

As shown in FIG. 2, support unit 10 includes four tubular members arranged substantially in one plane. The footing member 12 includes a straight central portion that rests horizontally on the ground or floor and extends beneath the table top 20 and benches 30. Each end of footing member 12 curves up and over itself in a near semi-circle before reversing direction into a short vertical section topped by a bench mounting plate 32. Utilizing through holes 2 and nuts and bolts, screws, or other common connectors 4, the bench seats 30 are detachably mountable to bench mounting plates 32. The bench seats 30 are wide enough to provide reasonable comfort for a person seated thereon, and are approximately the same length as the table top 20. The lower ends of support members 14L and 14r are welded at right angles to the upper surface of footing member 12 on opposite sides of and approximately ten inches from its longitudinal center.

The upper ends of parallel support members 14L and 14R are welded at right angles to the lower surface of cross member 16 on opposite sides of and each approximately 10 inches from its longitudinal center. Cross member 16 and center cross member 18 are substantially the width of the table top 20 and can be demountably attached to it, utilizing a plurality of through holes 2 in their upper and lower surfaces and connectors 4.

Figure 3:
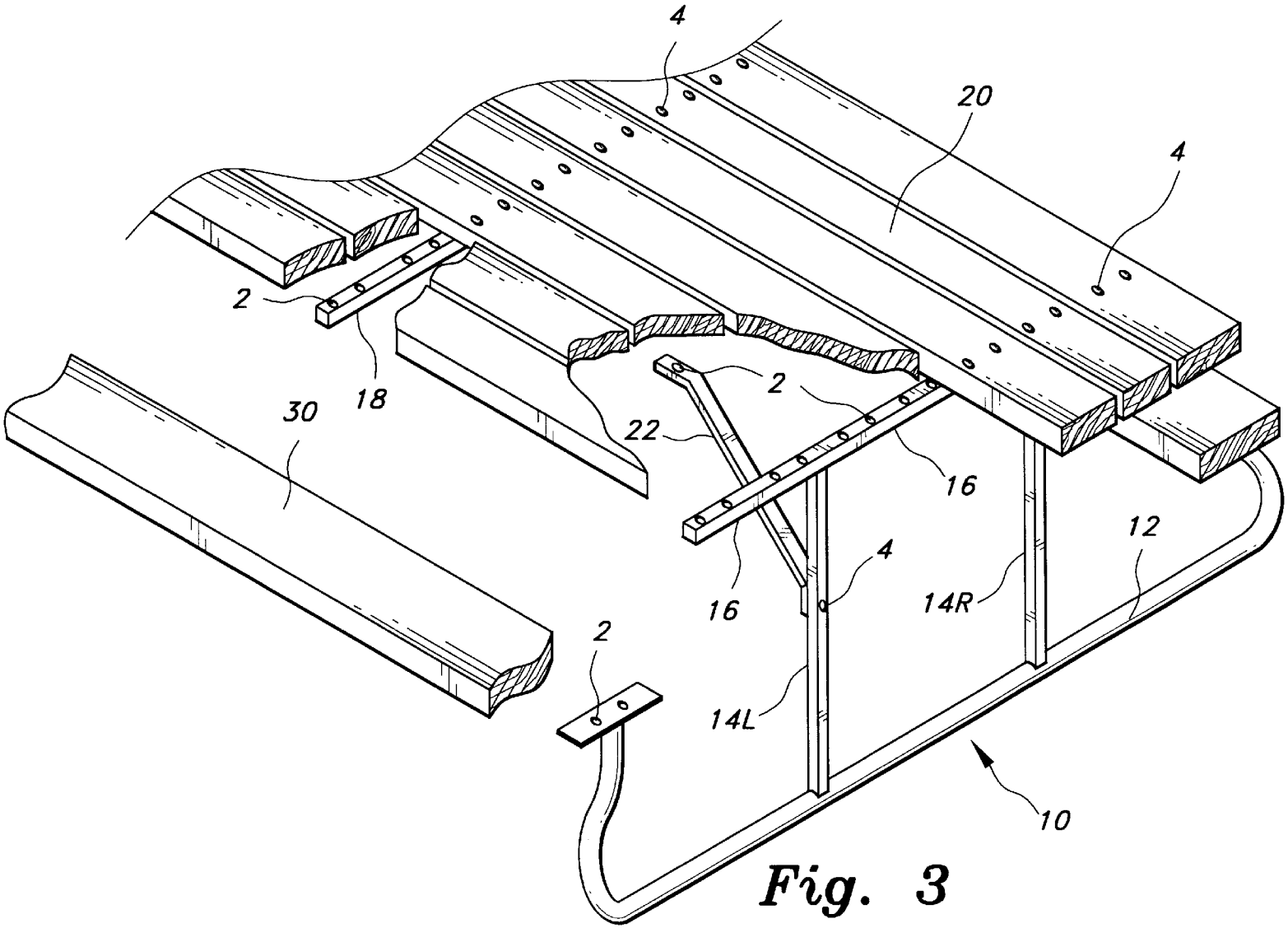
FIG. 3 is a fragmented, perspective view of a picnic table broken away and showing through-holes in support members used to demountably attach the table top and bench seats.
Figure 4:
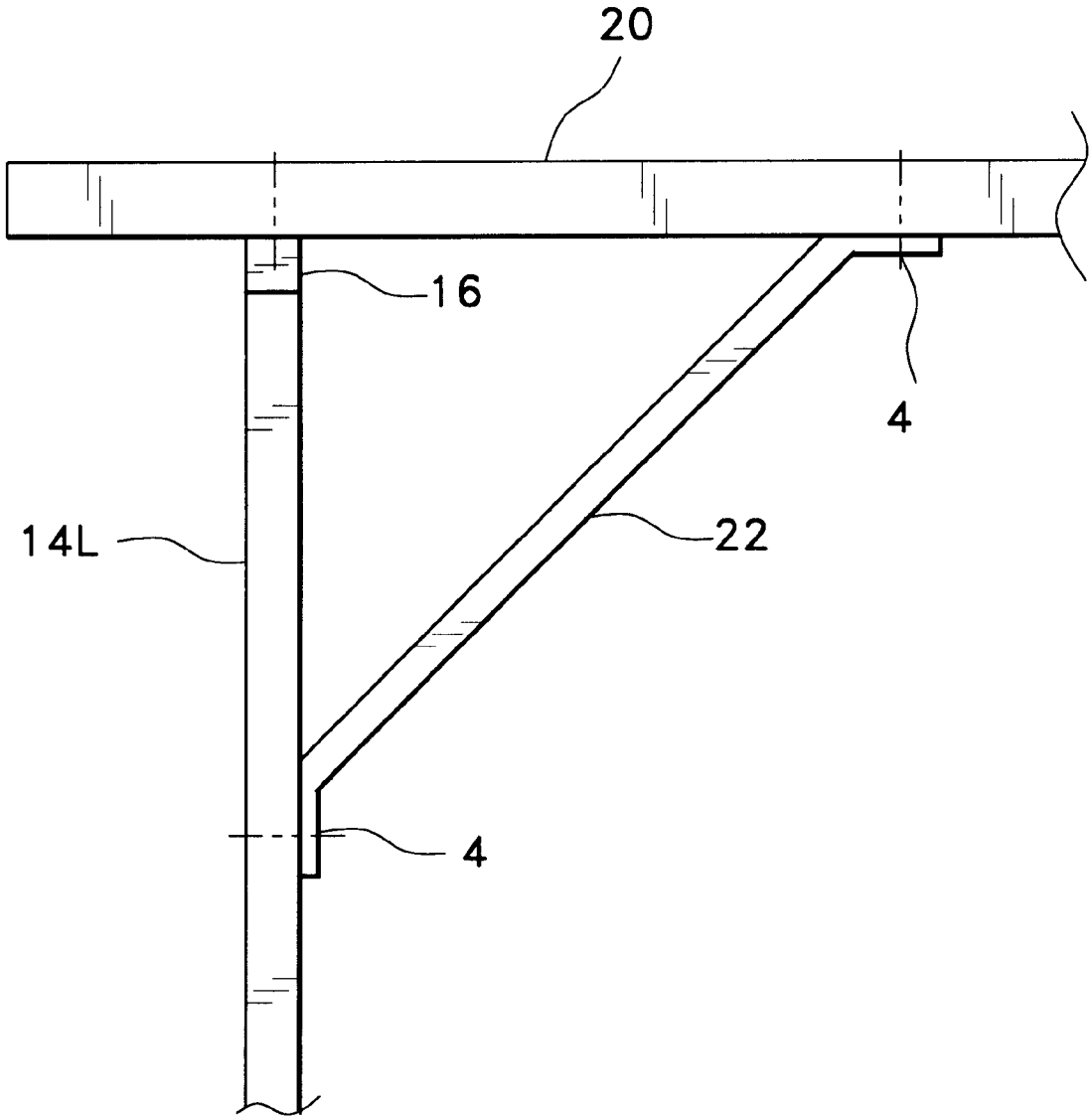
FIG. 4 is an elevational view of a section of the picnic table top and support unit showing placement of a diagonal brace.

Further, as shown in FIGS. 1, 3, and 4, substantially identical metal braces 22 and 22' extend upward at approximately 45° from the support members 14L and 14L' toward the table top 20. The braces 14L and 14L' are in planes parallel to and approximately 12" from the edges of the table top 20 that are adjacent to benches 30.

As seen in FIGS. 3 and 4, brace 22 has a flange extending from each end at substantially a 45 ° angle to its longitudinal axis. Employing a through hole 2 in each flange, the braces 22 and 22' are removably attachable to the support members 14L and 14L'and the table top 20 with connectors 4.

Preferably the frame members 12, 14L, 14L', 14R, 14R', 16, 18, 22, and 22' are made from steel tubing. Preferred dimensions of the footings 12 are 1½" diameter tubing, and the upright support members 14L, 14L', 14R, and 14R' are preferably ¾" square weather resistant coating to prevent rust and corrosion. The hardware members of the frame may be marketed as a kit, the user supply the lumber for the table top 20 and bench seats 30.

It is to be understood that the present invention is not limited to the embodiment described above, but encompasses any and all embodiments within the scope of the following claims.

I claim:

1. A picnic table with attached benches comprising:

a) a pair of end support members, each of said end support members having:

(i) a footing made from circular tubing having an elongated, linear central portion and opposing ends, the opposing ends forming semicircular arcs above the central portion and reversing direction into a short vertical section extending away from said central portion;

(ii) two spaced-apart vertical uprights parallel to each other and attached to the central portion of said footing;

(iii) a table top support cross member parallel to said central portion and attached to said two vertical uprights; and (iv) a bench mounting plate attached to each said short vertical section at a center point of each bench mounting plate, wherein each said bench mounting plate is maximally supported by each said short vertical section;

(b) a table top attached to the cross member of each of said end support members;

(c) a bench seat attached to the bench mounting plates of each of said end support members; and (d) a pair of struts extending between said table top and one of said vertical uprights on diagonally opposite sides of said table top.

2. The picnic table according to claim 1, further comprising a center cross member extending across said table top between and parallel to the table top cross member of each of said end support members.

3. The picnic table according to claim 1, wherein each said footing, said vertical uprights, and said table top cross members are tubular.

4. The picnic table according to claim 1, wherein each said footing, said vertical uprights, said table top cross members, and said bench mounting plates are permanently joined.

5. The picnic table according to claim 1, wherein said table top comprises a plurality of wood boards spaced apart and in parallel disposed on said end support members.

6. A hardware kit for assembling a picnic table with benches, comprising:

a) a pair of end support members, each of said end support members having:

(i) a footing made from circular tubing having an elongated, linear central portion and opposing ends, the opposing ends forming semicircular arcs above the central portion and reversing direction into a short vertical section extending away from said central portion;

(ii) two spaced-apart vertical uprights parallel to each other and attached to the central portion of said footing;

(iii) a table top support cross member parallel to said central portion and attached to said two vertical uprights; and (iv) a bench mounting plate attached to each said short vertical section at a center point of each bench mounting plate, wherein each said bench mounting plate is maximally supported by each said short vertical section; and b) a pair of struts, each strut having a first end attached one of said vertical uprights and a second end adapted for attachment to a table top.

7. The hardware kit according to claim 6, further comprising a center cross member adapted for extending across a table top between and parallel to the table top cross members of said end support members.

8. The hardware kit according to claim 6, wherein each said footing, said vertical uprights, and said table top cross members are tubular.

9. The hardware kit according to claim 6, wherein each said footing, said vertical uprights, said table top cross members, and said bench mounting plates are permanently joined.

10. A picnic table with attached benches consisting essentially of:

a) a pair of end support members, each of said end support members having:

(i) a footing made from circular tubing having an elongated, linear central portion and opposing ends, the opposing ends forming semicircular arcs above the central portion and reversing direction into a short vertical section extending away from said central portion;

(ii) two spaced-apart vertical uprights parallel to each other and attached to the central portion of said footing;

(iii) a table top support cross member parallel to said central portion and attached to said two vertical uprights; and (iv) a bench mounting plate attached to each said short vertical section at a center point of each bench mounting plate, wherein each said bench mounting plate is maximally supported by each said short vertical section;

(b) a table top attached to the cross member of each of said end support members;

(c) a bench seat attached to the bench mounting plates of each of said end support members; and (d) a pair of struts extending between said table top and one of said vertical uprights on diagonally opposite sides of said table top.

11. The picnic table according to claim 10, further comprising a center cross member extending across said table top between and parallel to the table top cross member of each of said end support members.

12. The picnic table according to claim 10, wherein each said footing, said vertical uprights, and said table top cross members are tubular.

13. The picnic table according to claim, 10, wherein each said footing, said vertical uprights, said table top cross members, and said bench mounting plates are permanentlyjoined.

14. The picnic table according to claim 10, wherein said table top comprises a plurality of wood boards spaced apart and in parallel disposed on said end support members.

* * * * *